US011662122B2

(12) United States Patent
Nolte et al.

(10) Patent No.: US 11,662,122 B2
(45) Date of Patent: May 30, 2023

(54) TANKLESS WATER HEATER SYSTEM

(71) Applicant: Stiebel Eltron GmbH & Co. KG, Holzminden (DE)

(72) Inventors: Hubert Nolte, Höxter (DE); Michael Dion, Northhampton, MA (US); Frank Stiebel, West Hatfield, MA (US)

(73) Assignee: Stiebel Eltron GmbH & Co. KG, Holzminden (DE)

( * ) Notice: Subject to any disclaimer, the term of this patent is extended or adjusted under 35 U.S.C. 154(b) by 797 days.

(21) Appl. No.: 16/515,250

(22) Filed: Jul. 18, 2019

(65) Prior Publication Data

US 2021/0018221 A1 Jan. 21, 2021

(51) Int. Cl.

| | |
|---|---|
| ***F24H 9/20*** | (2022.01) |
| ***F24H 1/10*** | (2022.01) |
| ***H05B 3/00*** | (2006.01) |

(52) U.S. Cl.

CPC ..... *F24H 9/2028* (2013.01); *F24H 1/102* (2013.01); *H05B 3/0019* (2013.01); (Continued)

(58) Field of Classification Search

None

See application file for complete search history.

(56) References Cited

U.S. PATENT DOCUMENTS 2,419,429 A * 4/1947 Voiles ..... F24H 1/103 392/486

2,700,505 A * 1/1955 Jackson ..... F24D 19/1096 392/377

(Continued)

FOREIGN PATENT DOCUMENTS

DE 4343256 C2 11/2000

OTHER PUBLICATIONS

German Search Report dated Jun. 24, 2021.

*Primary Examiner* — Thor S Campbell

(74) *Attorney, Agent, or Firm* — Haug Partners LLP

(57) ABSTRACT

A tankless water heater system (100), with a heat exchanger device (20) comprising at least one hollow chamber (21, 22, 23, 24) and at least one electrical heating element (52, 53, 54), and a controller device (30) with a temperature control unit (35), a tap event counter unit (32), a down-time counter unit (33) and a time delay unit (34); an electrical switching element (41, 42, 43) for connecting or is connecting one or several heating elements (52, 53, 54) to/from a power supply; an outlet temperature sensor (27) linked with the temperature control unit (35); a flow rate sensor (29); wherein: the tap counter unit (32) is connected to the flow rate sensor (29) and is triggered when water flow rate exceeds a tap indication threshold the down-time counter unit (33) is triggered and retriggered by the tap counter unit (32) and both provide a down-time event signal after any inactivity period with no water flow and records the duration of inactivity; the time delay unit (34) is connected to and triggered by the tap counter unit (32) starting a delay period which duration is switched from a short default delay period to a long delay period by the down-time signal provided by the down-time counter unit (33); and the switching elements (41, 42, 53) are triggered by the time delay unit (34) only after the delay period has elapsed.

13 Claims, 4 Drawing Sheets

(52) U.S. Cl.
CPC .... *F24H 2250/02* (2013.01); *H05B 2203/021* (2013.01); *H05B 2203/035* (2013.01)

(56) References Cited

U.S. PATENT DOCUMENTS 4,129,178 A * 12/1978 Hucke ..... F24H 7/0433 165/104.31
4,567,350 A * 1/1986 Todd, Jr. ..... F24H 1/102 392/489
5,129,034 A * 7/1992 Sydenstricker ..... F24H 1/102 392/488
5,216,743 A * 6/1993 Seitz ..... F24H 1/102 73/204.16
5,408,578 A * 4/1995 Bolivar ..... F24H 1/102 219/494
5,504,306 A * 4/1996 Russell ..... F24H 9/2028 323/236
6,080,971 A * 6/2000 Seitz ..... F24H 9/2028 219/486
6,246,831 B1 * 6/2001 Seitz ..... F24H 9/2021 219/483
6,393,212 B1 * 5/2002 Hutchinson ..... F04B 19/027 392/491
6,539,173 B2 * 3/2003 Chu ..... F24H 9/2028 392/450
6,647,204 B1 * 11/2003 Hutchinson ..... A47L 11/4088 392/491
9,040,880 B2 * 5/2015 Potter ..... F24H 9/2028 219/494
9,657,965 B2 * 5/2017 Nolte ..... F24H 9/45
9,709,299 B2 * 7/2017 Jansen ..... F24H 9/0021
9,791,168 B2 * 10/2017 Jansen ..... F24H 1/103
2010/0193492 A1 * 8/2010 Hughes ..... F24H 9/2028 219/162
2021/0018221 A1 * 1/2021 Nolte ..... H05B 3/0019

* cited by examiner

TANKLESS WATER HEATER SYSTEM

FIELD OF THE INVENTION

The present invention relates to a tankless water heater system, in particular a tankless water heater system for a drench shower.

BACKGROUND OF THE INVENTION

Tankless water heaters instantly provide warm or even hot water on demand. After a valve or faucet has been opened water is heated while it flows through the water heater system. Heating is performed by one or multiple electrical heating elements which extend into the water path. The defined heat capacity of the water heater limits the temperature rise the heater is able to deliver at certain water flow rate. Because only one electrical heating element or a small number of electrical heating elements is required for those purposes the so-called thermic mass i.e. the storage capacity for heat is low in such systems.

However, there are special appliances where large flow rate of warm water has to be provided rapidly like e.g. in an emergency drench shower. Emergency drench showers dealing with large flow rate and multiple shower heads to cause a spate of water quickly cleans individual contaminated by hazardous materials like acid or lye used in the chemical industry, for example. To instantly provide such large flow rate of warm water for flushing at an adequate temperature rise, sufficient electrical power is needed to simultaneously operate a series of a couple of electrical heating elements. As long as water continues to flow the heating process and the temperature control process is easy to handle if enough electrical power is installed. The required electric power can automatically be adjusted to the current water flow rate and/or to the required temperature rise and is constantly monitored by an outlet temperature sensor as well.

For a number of successive tapping events an undesired temperature rise may occur which increases the scalding risk. Such problems are aggravated if this happens frequently and the duration of inactivity is shorter than the duration of tapping. During idle time the latent heat stored in the large thermic mass of heating elements and stainless-steel chambers in which they are arranged still heats up the stagnating residual water even though electric power is interrupted. When water is tapped again the hot residual water runs out of the fixture may cause an enormous scalding risk for the user. The temperature rise caused by latent heat energy is completely out of control by the temperature control unit of the water heater system. The latent heat problem is increased when sheated copper or stainless-steel elements are used to heat the water.

SUMMARY AND OBJECTS OF THE INVENTION

In accordance with a preferred embodiment of the invention, a tankless water heater system is provided which incorporates a heat exchanger device comprising at least one hollow chamber and at least one electrical heating element, further comprising at least:

- a controller device with a temperature control unit, a tap event counter unit, an down-time counter unit and a time delay unit;
- an electrical switching element for connecting or disconnecting one or several heating elements to/from a power supply;

- an outlet temperature sensor linked with the temperature control unit; and
- a flow rate sensor.

It is a primary objective of the invention to provide a tankless water heater system in which any scalding risk is avoided, and which is suitable to be used in special appliances like an emergency shower or drench shower where large flow rate of warm water need to be provided instantly and repeatedly.

This objective is achieved by an improved controller having a temperature control unit, a tap event counter unit, an down-time counter unit and a time delay unit wherein:

- the tap event counter unit is connected to the flow rate sensor and is triggered as soon as water flow rate exceeds a tap indication threshold;
- the down-time counter unit is retriggered by the tap counter unit and both provide a down-time event signal after any inactivity period with no water flow and records the duration of inactivity;
- the time delay unit is connected to and triggered by the tap event counter unit starting a delay period which duration varies from a short default delay period to a long delay period defined by the off-time signal provided by the off-time counter unit;
- the heat event start is triggered by the time delay unit only after the delay period has lapsed.

The main effect of the invention is based on a pre-emptive temperature control which avoids a too high water temperature at the water outlet by considering the amount of potential latent heat stored in the thermic mass of the heating elements and/or the chamber walls of the heat exchanger device as well as the time period in which latent heat energy can be transferred to the residual water in the device before restarting the heating process by activating the heating elements in a new tapping cycle. Therefore, a time delay unit is integrated into the controller device to switch on the heating elements only after a certain delay period has lapsed. The delay period is considered as a kind of safety time period beginning with the start of the tapping cycle to avoid scalding.

In order to consider the user's behavior in relation to the number and duration of tapping respective the duration of interruptions between tapping there is also a tap event counter unit integrated into the controller device. The tap event counter unit records the duration of inactivity since tapping has been previously stopped and/or the number of interruptions within a preset monitoring period. If either of these values exceeds a certain threshold a down-time signal is sent to the time delay unit to extend or to reduce the time delay period. Thereby a variable time function is implemented in the tankless water heater system of the invention.

In another embodiment there is an additional inlet temperature sensor arranged upstream, in the vicinity of the water inlet opening, and the controller further comprises a caloric calculation unit. The caloric calculation unit has four main input values which are

- the inlet water temperature,
- the outlet water temperature,
- the flow rate and
- the duration of the tapping interval.

By the temperature difference between inlet and outlet-temperature and by the flow rate signal the required to heat up the water stream during a certain time interval to a desired set outlet temperature can be calculated. The relevant time interval is defined by the beginning and the end of the tapping process. Furthermore, there is a link provided from the caloric calculation unit to the temperature control unit in order to sum the electrical energy applied to the heating elements during the same time interval. Having a) calculated the amount of energy actually consumed for heating up the water and b) knowing the amount of electrical energy applied to the heating elements in common, the latent heat energy is the amount of energy stored in the thermal mass of the system can be calculated. With the water temperature of residual water at the end of the heating event and the volume of residual water in the heat exchanger device a forecast of the development of outlet water temperature at the beginning of the next tapping cycle can be calculated.

To achieve an even more precise result of temperature rise due to calculated latent heat, a heat loss rate can experimentally be determined and considered in calculations in another improved embodiment of the invention.

In still another embodiment of the tankless water heater system of the invention a safety valve and a bypass are connected to the outlet. Only if the temperature at the outlet is below a safety threshold $T_{max}$ the valve is opened to let water pass to subsequent installations with user contact like shower heads. Otherwise, the water is delivered via a bypass to a buffer tank or a drain.

It is a further objective to provide a method for operating a tankless water heater system, comprising at least a heat exchanger device with one hollow chamber and at least one electrical heating element, an outlet temperature sensor and a flow rate sensor;

a controller device and an electrical switching element for connecting or disconnecting the heating element to/from a power supply;

The objective of the invention is achieved by a method with the following steps:

verifying the user behavior by monitoring the flow rate $\dot{V}_0$ with a flow rate sensor and verifying the water temperature T by monitoring the outlet water temperature sensor whether both water flow rate exceeds a tap indication threshold and water temperature is below a set-point temperature $T_1$;

Checking heat exchanger temperature by using the information of the outlet temperature sensor representative as setting a delay period to a short default delay period if heat exchanger temperature is determined to be cold;

if heat exchanger is cold then checking the system for a preceding inactivity period $\Delta t_{OFF}$ during which flow is interrupted and no heating occurs; resetting the delay period to the short default delay period $\Delta t$ if inactivity period $\Delta t_{OFF}$ is longer than a preset off-time value or increasing the long delay period $\Delta t$ for each occurrence of inactivity;

heating the water in the heat exchanger device buy switching on the heating element after the end of the delay period $\Delta t$ and performing water heating with continuous temperature control until flow is interrupted.

BRIEF DESCRIPTION OF THE DRAWINGS

These and other objects of the invention will be appreciated and understood by those skilled in the art from the detailed description of the preferred embodiment of the invention and from the following drawings in which.

DETAILED DESCRIPTION OF A PREFERRED EMBODIMENT

Figure 1:
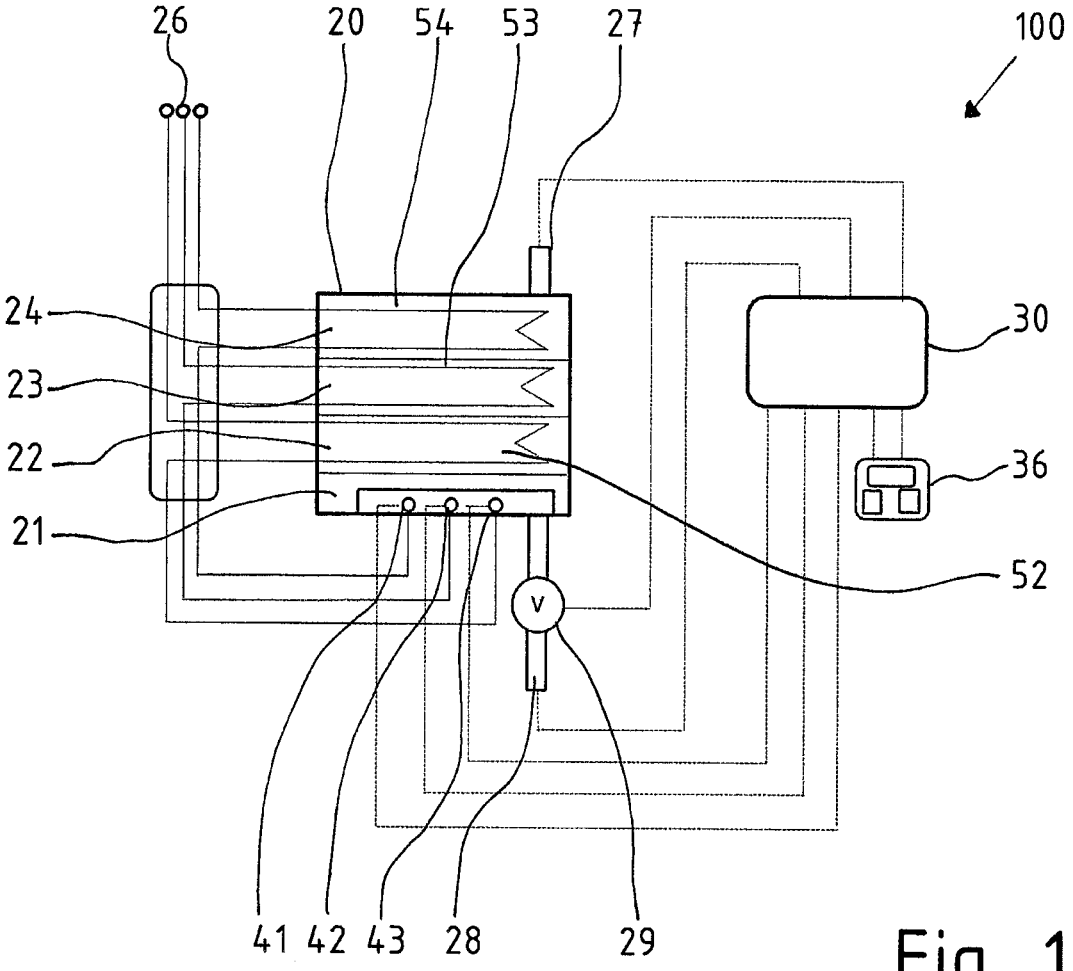
FIG. 1 is a schematic of a tankless water heater system.

With reference to the drawings wherein like numerals designate like or corresponding elements throughout the several views, it will be seen that the invention relates to a tankless water heater system 100 as illustrated in the schematic in FIG. 1.

The basic components of the tankless water heater system 100 are a heat exchanger device 20 and a controller device 30. These components may be physically integrated in a common housing, but the exchanger device 20 can also be operated by the controller device 30 arranged in a remote location wherein the heat exchanger device 20 and the controller device 30 are linked by wires and/or by wireless connections.

In the illustrated embodiment of the invention the heat exchanger device 20 is built from a sequence of stainless-steel heating tubes 21, 22, 23, 24 welded together, where the water runs through openings in the beginning and the end of each tube thereby constituting a meandering water flow path between inlet opening at the bottom of tube 21 and an outlet opening at the top of tube 24. For clarity's sake only four tubes 21, 22, 23, 24 are illustrated in FIG. 1 to explain the invention whereas a real embodiment of a heat exchanger comprises a stack of more than a dozen chambers in each of which an electrical heating element is arranged.

The heat exchanger device 20 has a connector panel 26 to be connected to a multiphase power supply. An inlet temperature sensor 28 and a flow-rate sensor 29 are arranged at the inlet opening and an outlet temperature sensor 27 is arranged at an outlet opening of the heat exchanger device 20. Each steel heating tube 21, 22, 23, 24 is provided with at least one electrical heating element 52, 53, 54. Each of the heating elements 52, 53, 54 is connected to the connector panel 26 and to a switching element 41, 42, 43. The switching elements 41, 42, 43 are triacs which are all arranged in the bottom-most steel tube 21 so they can be cooled by the cold water entering the flow path there.

The electronic controller device 30 with a microprocessor is controlling the firing rate of the triacs arrangement to control the heat output of each heating element 52, 53, 54. Furthermore the controller device 30 is fed with data and/or other signals from the temperature outlet sensor 27, the temperature inlet sensor 28 and the flow rate sensor 29. It has also a user interface 36.

Figure 2:
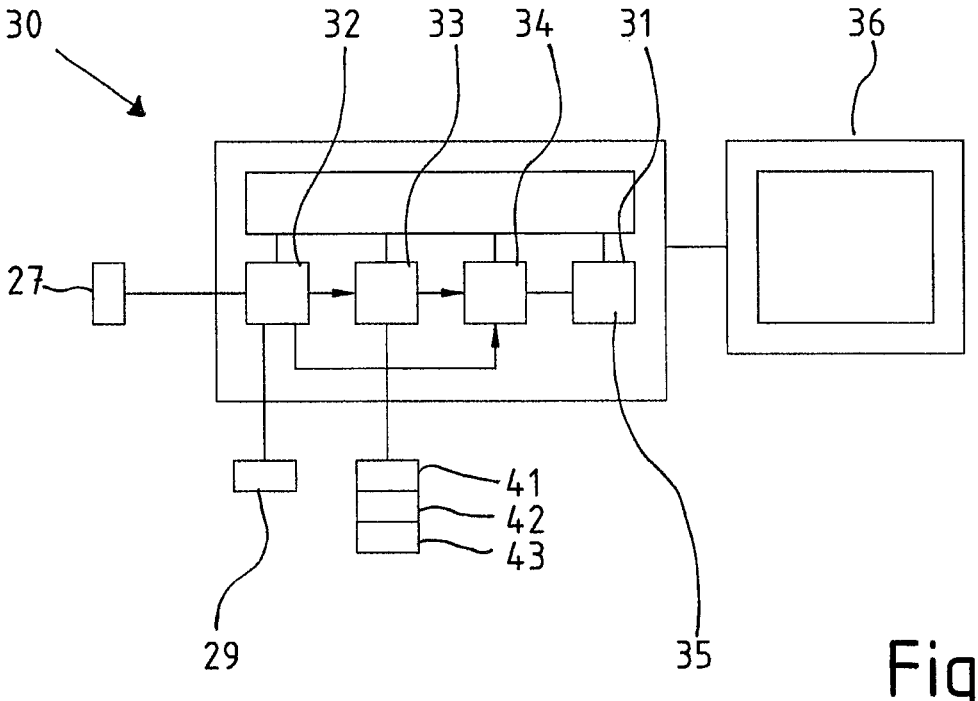
FIG. 2 is a schematic of a controller device.

The inner structure of the controller device 30 is shown in the schematic illustration in FIG. 2 in more detail. It is controlled by a microprocessor 31 and equipped with a software program to control the activation and deactivation of the heating elements 52, 53, 54 and the outlet temperature close to a desired setpoint. The setpoint information is delivered to the controller device 30 by the user interface 36 with a display and buttons and/or knobs for adjustments like selecting the desired temperature setpoint.

The controller device 30 comprises several units:

a temperature control unit 35, a tap counter unit 32, a down-time counter unit 33 and a time delay unit 34.

In terms of a software program they are incorporated as modules, routines and/or subroutines. In terms of hardware they are integrated subunits or units which are interlinked, e.g. by a data bus.

The tap event counter unit 32 is connected to the flow rate sensor 29 and to the outlet temperature sensor 27. It is triggered when the water flow rate $\dot{V}$ exceeds a tap indication threshold $\dot{V}_1$ and the outlet water temperature is below a temperature threshold $T_1$.

The down-time counter unit 33 is retriggered by the tap counter unit 32 each time when tapping is interrupted and provides a down-time signal after an inactivity period with no water flow.

The time delay unit 34 is connected to and triggered by the tap counter unit 32 starting a delay period $t_1$ which duration is switched from a short default delay period to a long delay period by the down-time signal provided by the down-time counter unit 33.

The switching elements 41, 42, 43 are connected to the controller device 30 as well. Dependent from the outlet water temperature at the sensor 27 one or more switching elements 41, 42, 43 are triggered to switch on the number of electrical heating elements 52, 53, 54 which are required to heat up to the desired outlet temperature of the water. The switching elements 41, 42, 43 can only be activated once the delay period is over. The delay period is set by the time delay unit 34.

The software in the controller device 30 incorporates a method of the invention to operate a tankless water heater system without the risk of scalding by latent heating effects from thermic masses.

The method will be described in detail with reference made to the flowchart in FIG. 3:

A starting block 201 of the control process 200 runs in the controller device 30. It is also an end point in an endless loop or a rolling control process.

The signal or data provided by the flow sensor 29 is monitored and compared at decision block 202 with a preset minimum flow rate designated as the tap indication threshold $\dot{V}_1$ which causes the control process to be restarted at block 201. The measured flow rate value $\dot{V}_1$ is below that tap indication threshold $\dot{V}_1$ if there is no flow at all or just water dripping.

Once the flow-rate $\dot{V}_1$ is above the threshold level $\dot{V}_1$ recognized in decision block 202 a temperature comparison routine 203 is performed. Comparison is made with the temperature setpoint $T_1$ selected by the user. If the current water temperature T measured is above selected $T_1$, then no heating will be required at all and the control process will be restarted at block 201. If the current temperature T is below the set point temperature $T_1$, then the next temperature comparison is made at decision block 204 where the heat exchanger temperature is evaluated using the temperature information from the outlet temperature sensor. The temperature information T is fed into decision block 204.

If the heat exchanger 20 is cold, then a short delay period is selected in the time delay unit 34 at decision block 204. It is a preferred feature of the invention that there is always a short delay period defined which lasts for at least 1 second. This short delay is useful to vent air out of the system. Any air shield however thin it might be would insulate the metal surface of the heating elements from the fluid causing the risk of overheating the heating elements because heat transfer into the water would be blocked by the air film at least partially.

After the end of the delay period the heating process can start at block 208 which is controlled by the temperature control unit 35 in order to heat up the outlet water temperature close to the set-point $T_0$. Heating is either performed constantly by adjusting electrical output power provided to all heating elements in common, or by heating in several short time intervals with constant power. A third way of adjustment can be chosen by selectively switching on only a part of the multiple heating elements provided in the device.

The heating process will be terminated if the water flow is interrupted or if the water temperature T is close to the temperature preset value $T_0$. If either of these conditions is met, both the heating process at block 208 is interrupted and the monitoring process is restarted at block 201.

In contrast, if it is determined at decision block 204 that the heat exchanger device 20 is still hot, the next condition will be evaluated at decision block 205. If there is a down-time event detected by the down-time counter unit 33, the delay period will be increased significantly to a long delay period which can initially last 5 seconds, for example. The exact value depends on the design of the heat exchanger device 20, the number of heating elements 52, 53, 54, the insulation characteristics, etc. It is always preset to make sure that latent heat energy cannot raise the water temperature above a safety temperature threshold.

The linkage of the temperature control unit 35, the down-time counter unit 33 and the time delay unit 34 is an important feature because all elements rule interactively whether heating is started by switching on at least one heating element or not. The down-time counter unit 33 is used to control a temperature build up by a variable timer function where the time-out duration depends on the number of successive tapping events each followed by an inactive period.

Figure 3:
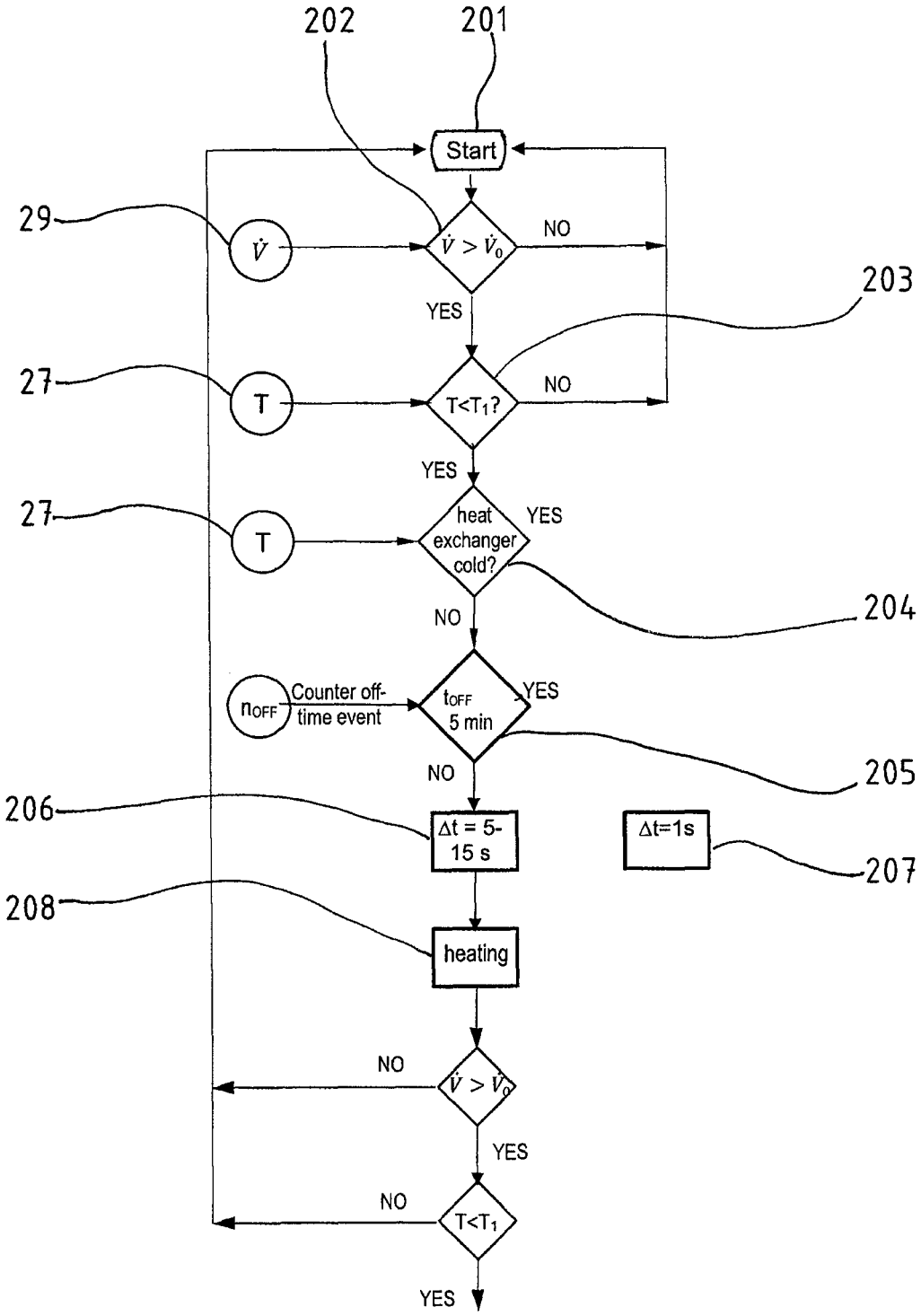
FIG. 3 a flowchart of the software run in the controller device.

In the example of the process which is illustrated in the flowchart of FIG. 3 the temperature setpoint $T_1$ is set to 100° F. A heating down-time period is defined as $t_{OFF}$=5 min.

- If the value of the outlet temperature sensor 27 is more than 100° F. the status of the heat exchanger device 20 at block 204 is considered as "hot", otherwise it is "cold".
- If the status is "cold", the delay period is set to the short period like 1 second regardless if there are successive short tapping events or activation events.
- If the status is "hot", the delay period calculated by the time-delay unit 34 starts to increase for each successive activation following a heating down-time of less than $t_{OFF}$=5 min. The down-time $t_{OFF}$ is recorded in the down-time counter unit 33. Only if the down-time period lasts longer than $t_{OFF}$, the delay period will be reset to 1 second.
- For the first down-time occurrence, the delay period is set to 5 seconds. For the second event it is 10 seconds and for the third occurrence it is 15 seconds. The delay period is set in block 206.
- For any successive events the delay period will remain at 15 seconds until there is a period of total inactivity of at least 5 minutes. After such an inactivity period, the delay period will be reset to 5 seconds.

Figure 4:
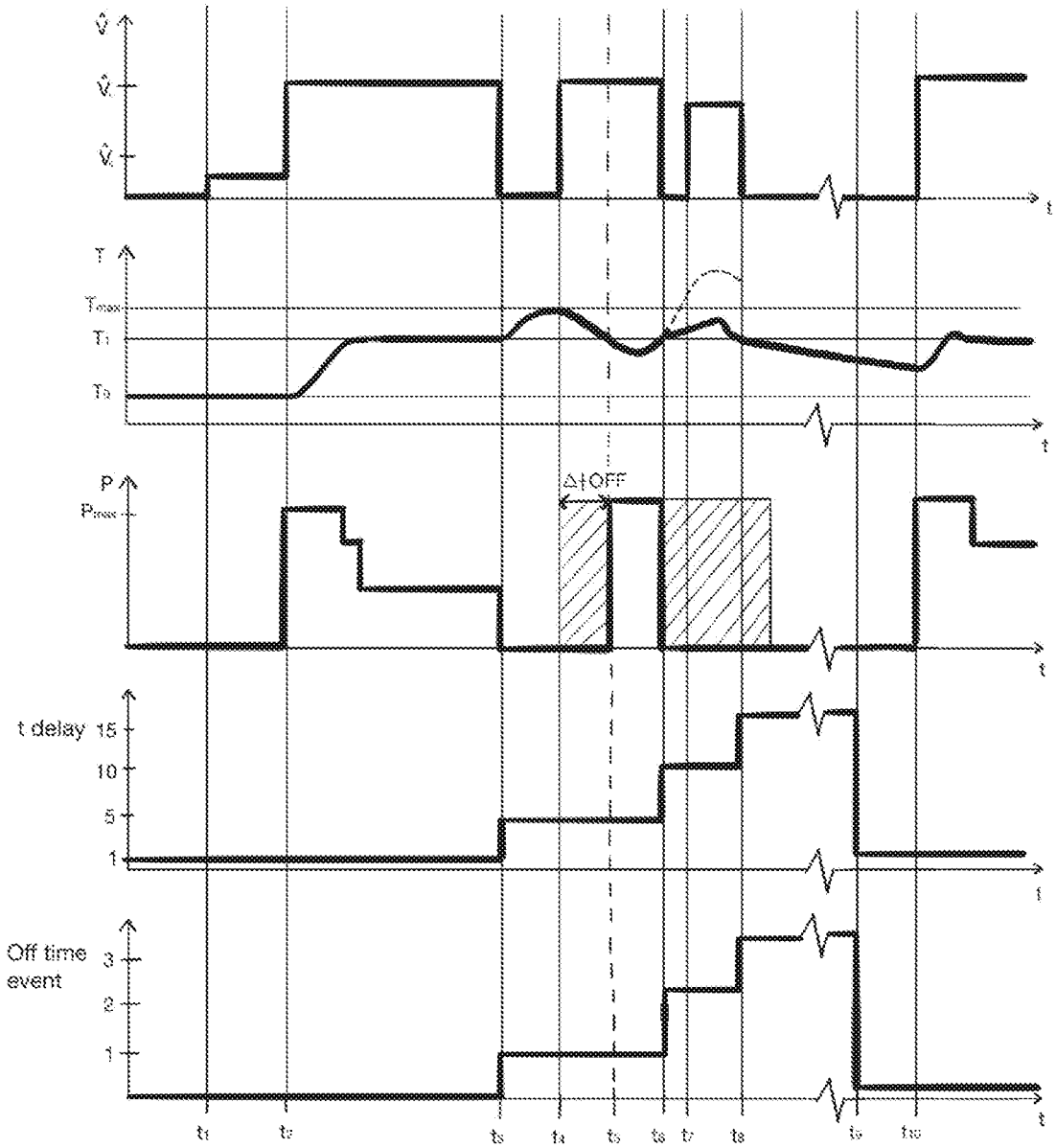
FIG. 4 multiple diagrams of parameters over a common timeline.

With reference made to FIG. 4 the function of the tankless water heater system 100 of the invention and the method for operating will be described in detail. FIG. 4 shows five diagrams over a common timeline t for:

- flow-rate $\dot{V}_1$ measured by flow rate sensor 29,
- water outlet temperature T measured by outlet temperature sensor 27,
- electrical power P applied to stack of heating elements 52, 53, 54,
- time delay Δt and
- down-time event counter $n_{OFF}$.

When the operation of the tankless water heater system 100 starts at t=0 no flow is indicated thus $\dot{V}$=0. With the begin of a tapping event the water temperature $T_0$ can be at ambient temperature or lower when the system is set into operation, or it corresponds to the temperature of the previous heating event. In FIG. 4 the water temperature T corresponds to the cold-water temperature which is about $T_0$=50° . . . 60° F. As no flow-rate is indicated none of the heating elements 52, 53, 54 is active so electrical power is P=0. The time delay Δt is set to a default value for a short delay period which is Δt=1 s. No down-time event has occurred so far, so the down-time counter being $n_{OFF}$=0.

At time $t_1$ the user opens the valve or faucet but only slightly. A flow-rate is recorded but $\dot{V}$ is still below a tap indication threshold $\dot{V}_1$. This is why the monitoring routine in the software of the controller returns from decision block 202 to start at block 201 (see FIG. 3). Water temperature T, electrical power P, delay period Δt and down-time event $n_{OFF}$ remain all unchanged.

At time $t_2$ the flow-rate $\dot{V}$ is above the tap indication threshold $\dot{V}_1$. Besides water temperature T is significantly below the temperature $T_1$ preset by the user so electrical power P is switched on with maximum power i.e. all available heating elements 52, 53, 54 are switched on after a very short time delay period Δt of 1 s which is defined to remove air contaminations from the heating elements' surface. Consequently, water temperature T rises. Before reaching the set-point value $T_1$ electrical power P is reduced by switching off one single heating element while heating continues with the remaining number of heating elements. When the temperature is close to the set-point $T_1$, more heating elements are switched off.

At time $t_3$ the flow is interrupted by the user resulting in the following effects:

Water temperature T still rises due to latent heat energy in the system, but as electrical power P has already been reduced before flow interruption took place the latent heat energy is limited. So, the water temperature T still stays below a safety threshold $T_{max}$.

A first down-time event is registered in the tap counter unit 32 so $n_{OFF}$=1.

With $n_{OFF}$=1 the time delay unit 34 is triggered thereby time delay period is set to the default value for a long delay period which is Δt=5 s.

At time $t_4$ which is only after a very short period of interruption beginning with $t_3$ the user starts tapping again so $\dot{V}$ is above the tap indication threshold $\dot{V}_0$ again. The flow of fresh water cools down the heat exchanger device 20 so outlet temperature T decreases, but due to the delay period Δt set to 5 s at time $t_3$ the full electrical power for all heating elements is switched on once the idle time $t_5$ of 5 s has elapsed. The left hatched area in the diagram for the power P represents the amount of energy which has not been made available to heat up the system because of the delay period. Otherwise the water temperature rises over the safety threshold $T_{max}$ causing a risk of scalding. Because of the delay period Δt applied the whole system is flushed with cold water first before temperature control is performed again.

At time $t_6$ the user interrupts the flow again for a very short until $t_7$. Due to the interruption, the down-time counter is set to $n_{OFF}$=2 and the delay period is extended by another 5 s to Δt=10 s in total. The delay period Δt last from $t_7$ when tapping is restarted. However, the flow interruption between $t_6$ and $t_7$ was even shorter than the delay period Δt=10 s, so no electrical power P was applied at all during that period of time. Again, the hatched area represents the amount of electrical energy which would have been applied to the system if tapping of water and switching on the heating elements occurred simultaneously as in prior art. The dashed line in the temperature diagram shows how water temperature T might rise if power is switched on with the restart of the tapping process immediately. In contrast, the continuous temperature line shows that in the heat exchanger system of the invention the temperature decreases.

At time $t_8$ the delay period Δt has still been lasting when flow is interrupted again, so another down-time event is registered in the tap counter unit 32 setting $n_{OFF}$=3 which is the maximum value in the exemplary process considered here. The delay period is extended by another 5 s to Δt=15 s which is the maximum for this value as well.

Each time when an interruption in water flow is registered both the down-time counter for the down-time events is set and the recording of the down-time $t_{OFF}$ is restarted. During the previous time period between starting point of the process at t=0 and $t_8$ the full down-time period of 5 minutes has never lapsed. However, a period of 5 minutes which has started at $t_8$ ends at $t_9$. At time $t_9$ the off-time counter is reset to zero and the time delay period is set back to the default value of 1 s.

So, at $t_9$ the system is reset to the same condition it was at the very beginning of the described process. No precautions are necessary because in this condition no latent heat problem may occur. Once a new tapping event begins, for example at $t_{10}$, the heating is activated nearly immediately after the minimum delay period of Δt=1 second which is provided to remove entrapped air from the system before heating starts.

The invention claimed is:

1. A tankless water heater system (100), with a heat exchanger device (20) comprising at least one hollow chamber (21, 22, 23, 24) and at least one electrical heating element (52, 53, 54), further comprising at least:

a controller device (30) with a temperature control unit (35), a tap event counter unit (32), a down-time counter unit (33) and a time delay unit (34);

an electrical switching element (41, 42, 43) for connecting or disconnecting one or several heating elements (52, 53, 54) to/from a power supply;

an outlet temperature sensor (27) linked with the temperature control unit (35);

a flow rate sensor (29);

wherein:

the tap counter unit (32) is connected to the flow rate sensor (29) and is triggered when water flow rate exceeds a tap indication threshold $\dot{V}_0$ the down-time counter unit (33) is triggered and retriggered by the tap counter unit (32) and both provide a down-time event signal after any inactivity period with no water flow and records the duration of inactivity;

the time delay unit (34) is connected to and triggered by the tap counter unit (32) starting a delay period $\Delta t_{OFF}$ which duration is switched from a short default delay period to a long delay period by the down-time signal provided by the down-time counter unit (33); and the switching elements (41, 42, 53) are triggered by the time delay unit (34) only after the delay period has elapsed.

2. The tankless water heater system of claim 1, wherein the long delay period is increased by each down-time signal provided by the down-time counter unit (33) until a maximum delay period is reached.

3. The tankless water heater system (100) of claim 2, wherein the controller (30) comprises a microcontroller (31) and a memory and wherein all units (32, 33, 34, 35) are implemented in a software program running in the controller device (30).

4. The tankless water heater system (100) of claim 3, wherein an inlet temperature sensor (28) is arranged near the water inlet opening and the controller device (30) further comprises a caloric calculation unit.

5. The tankless water heater system (100) of claim 1, wherein the switching elements (41, 42, 43) are triacs which are arranged in one or several upstream chambers (21) of the heat exchanger device (20).

6. The tankless water heater system (100) of claim 5, wherein several chambers (21, 22, 23, 24) are interconnected to constitute a fluid flow path extending from an inlet opening (24) through the chambers (21, 22, 23, 24) to an outlet opening (25).

7. The tankless water heater system (100) of claim 6, wherein one heating element (52, 53, 54) is arranged in each chamber (22, 23, 24) apart from the bottom most chamber (21) in which the triacs are arranged.

8. The tankless water heater system (100) of claim 7, wherein the chambers (21, 22, 23, 24) are rectangular steel tubes which are stacked in a single row or in multiple rows wherein the inlet opening is arranged at the bottom of the stack and the outlet opening on the top of the stack.

9. Method for operating a tankless water heater system (100), comprising at least a heat exchanger device (20) with one hollow chamber (21, 22, 23, 24) and at least one electrical heating element (52, 53, 54), an outlet temperature sensor (27) and a flow rate sensor (29);

a controller device (30) and an electrical switching element (41, 42, 43) for connecting or disconnecting the heating element (52, 53, 54) to/from a power supply;

wherein the method comprises:

verifying if water flows by monitoring the flow rate $\dot{V}$ with the flow rate sensor (29) and verifying water temperature T by monitoring the outlet temperature sensor (27) whether both water flow rate $\dot{V}$ exceeds a tap indication threshold $\dot{V}_0$ and water temperature T is below a set-point temperature $T_1$;

Checking temperature of the heat exchanger device (20) using temperature information from the outlet water temperature sensor (27) setting a delay period Δt to a short default delay period if heat exchanger is cold;

if heat exchanger device (20) is cold then checking the system for a preceding inactivity period $\Delta t_{OFF}$ during which the flow is interrupted and no heating occurs; resetting the delay period Δt to the short default delay period Δt if inactivity period $\Delta t_{OFF}$ has lasted longer than a preset down-time value or setting a long delay period Δt which is increased for each occurrence of inactivity;

heating the water in the heat exchanger device (20) by activating at least one of the heating elements (52, 53, 54) after the end of the delay period Δt and performing water heating with continuous temperature control until flow is interrupted.

10. The method of claim 9, wherein the short default delay period has a minimum of Δt=1 s.

11. The method of claim 10, wherein the long delay period is set to a minimum of Δt=5 s.

12. The method of claim 11, wherein the long delay period Δt is increased for each occurrence of inactivity by 5 s.

13. The method of claim 12, wherein the inactivity period $\Delta t_{OFF}$ is set to a minimum of 5 minutes.

* * * * *